United States Patent [19]

Conrad

[11] 3,936,094

[45] Feb. 3, 1976

[54] LOCKABLE TILTING CHAIR WITH FRICTIONAL TILT RESISTANCE

[76] Inventor: William Arthur Conrad, 1451 Edgewood SE., Grand Rapids, Mich. 49506

[22] Filed: Oct. 15, 1974

[21] Appl. No.: 514,482

[52] U.S. Cl. ..... 297/328; 248/371

[51] Int. Cl.[2] ..... A47C 1/027

[58] Field of Search ..... 297/301–304, 297/264–269, 316, 319, 326, 327, 328; 248/382, 384, 385, 372, 375, 371

[56] References Cited

UNITED STATES PATENTS

| | | | |
|---|---|---|---|
| 93,978 | 8/1869 | Evans | 248/375 X |
| 596,079 | 12/1897 | Morse | 248/375 X |
| 1,117,979 | 11/1914 | Cromer | 297/319 |
| 2,619,153 | 11/1952 | Van Osselen | 297/302 |
| 2,942,650 | 6/1960 | Hoffman | 297/327 |
| 3,044,827 | 7/1962 | Belisle | 297/316 X |
| 3,135,549 | 6/1964 | Larsson | 297/326 X |

FOREIGN PATENTS OR APPLICATIONS

| | | | |
|---|---|---|---|
| 494,971 | 11/1938 | United Kingdom | 297/337 |
| 41,026 | 6/1937 | Netherlands | 248/375 |
| 454,639 | 10/1936 | United Kingdom | 248/375 |

*Primary Examiner*—Francis K. Zugel
*Attorney, Agent, or Firm*—Glenn B. Morse

[57] ABSTRACT

A tiltable chair has a frictional resistance to tilting, and locking means releasably securing the erect position of the seat. Resistance to tilt preferably decreases with increased tilt angle, and is generated by the resilient engagement of bearing members acting against opposite surfaces for lateral neutralization of forces. The locking means is released in response to pressure on the chair seat.

5 Claims, 14 Drawing Figures

LOCKABLE TILTING CHAIR WITH FRICTIONAL TILT RESISTANCE

BACKGROUND OF THE INVENTION

Chairs in which the seat and back tilt as a unit usually include a base providing a fulcrum for the seat-back unit, and some sort of spring mechanism tending to bring the chair into erect position. This mechanism opposes the tilt with a progressively increasing force as the tilt angle increases. The fulcrum axis is normally underneath the seat, which brings the center of gravity of the occupant progressively to the rear as the tilt angle develops. This type of mechanism is frequently found in office swivel chairs, but is also appearing with greater frequency in residence furniture.

Spring-action chair mechanisms tend to become noisy with wear, or to become quite costly if sufficiently well built to reduce this tendency. The characteristic increasing resistance to tilt also requires the occupant of the chair to continually provide some degree of force against the floor, or against some other object, in order to maintain a tilted position. Over long periods of time, the resulting muscle strain becomes particularly noticeable. On release of this holding force, the occupant is immediately thrown forward as a result of the spring action.

A tilting mechanism that does not use a return spring is shown in my U.S. Pat. No. 3,227,491. A frictional resistance is substituted for the spring action, and the degree of resistance is preferably controlled so that it decreases with an increased angle of tilt. In the preferred form of the invention disclosed in that patent, this resistance gradient is accomplished by the use of an arcuate braking surface which is slightly eccentric to the axis of the fulcrum. A spring driving a plunger against the braking surface is progressively compressed as the chair approaches the erect position, and is extended as the chair tilts backward. The degree of resistance is sufficient to maintain the position of the occupant under normal conditions, and yet is free enough so that he can move back to erect position by slightly shifting his position. The tilt position is therefore a function of resistance and balance.

A chair of the type shown in U.S. Pat. No. 3,227,491, has an objectionable tendency to assume an angle of tilt when unoccupied. This is due primarily to the absence of any automatic return system, such as is present in the usual spring machanism. An accidental brushing against the chair, or an attempt to pull the chair across the floor by grasping the back, will inevitably produce a degree of tilt and affect the appearance of the chair. The type of mechanism shown in that patent has also been somewhat difficult to incorporate in certain designs of furniture without presenting some degree of distortion of the lines of design.

SUMMARY OF THE INVENTION

A tiltable support for a chair seat has a frictional resistance to tilting generated by the pressure of bearing members mounted either on the seat or on the fixed part of a mechanism frame acting in conjunction with opposed bearing surfaces mounted on the other of these components. Preferably, the bearing surfaces are on the opposite sides of a projection secured to the underside of the seat of the chair, and which enter between opposed bearing plungers acting under spring pressure. A progressively decreasing resistance to tilt is obtained by tapering the projection to reduced width in a direction downward from the seat of the chair. Tilting of the seat when it is unoccupied is prevented by the presence of a locking mechanism that secures the upright position of the seat until pressure on the seat releases the locking mechanism.

DESCRIPTION OF THE PREFERRED EMBODIMENTS

Figure 1:
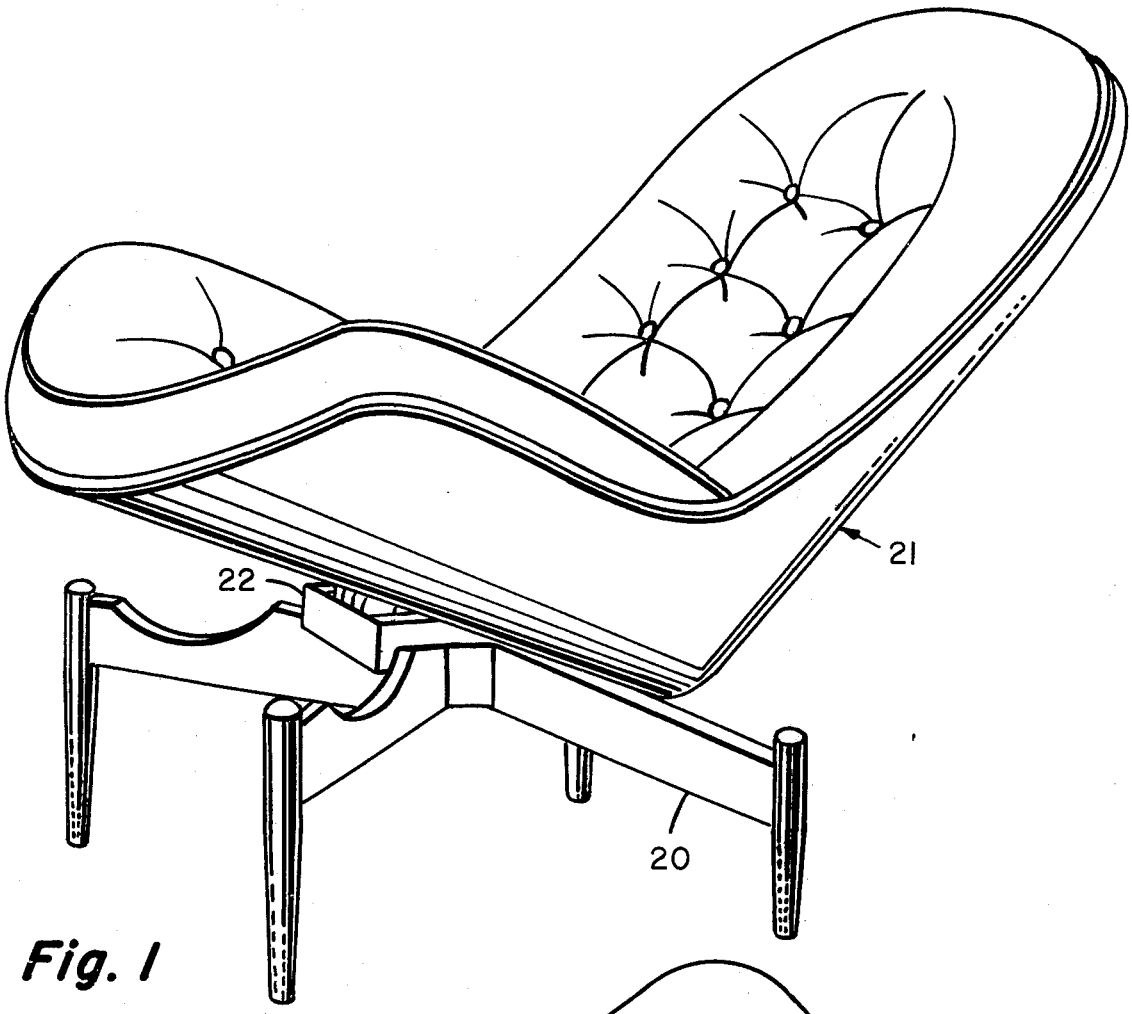
FIG. 1 is a perspective view of a chair incorporating the present invention, shown in the tilted position.
Figure 2:
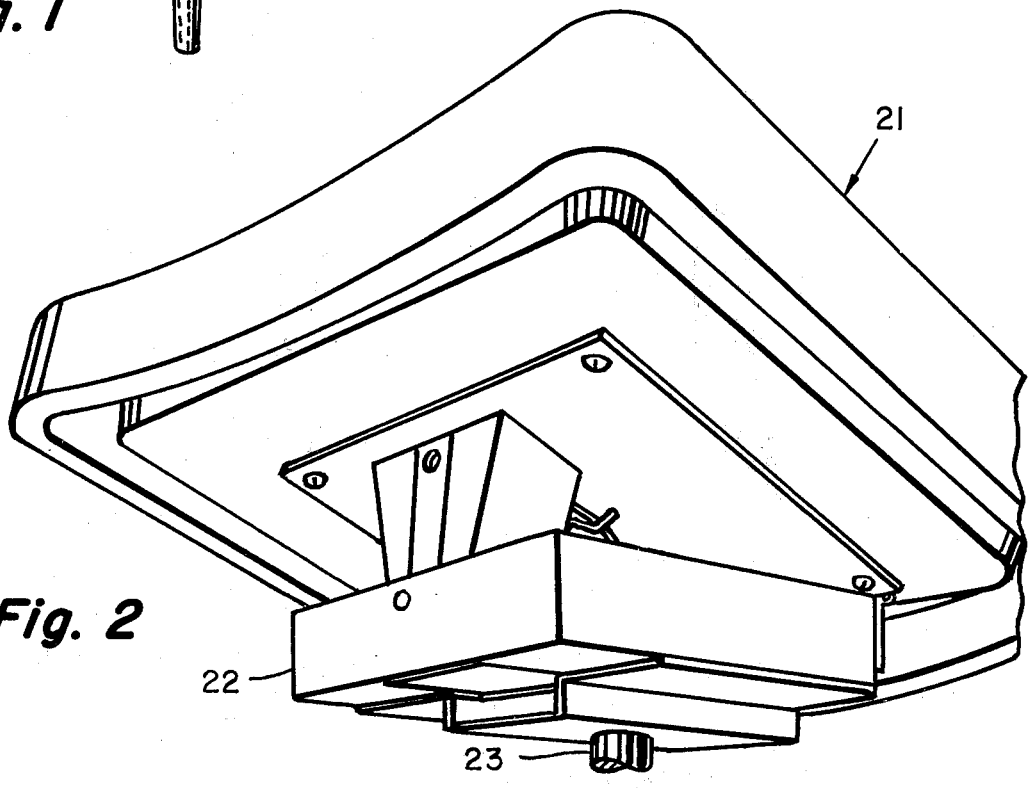
FIG. 2 is a perspective view of the underside of the chair shown in FIG. 1.
Figure 5:
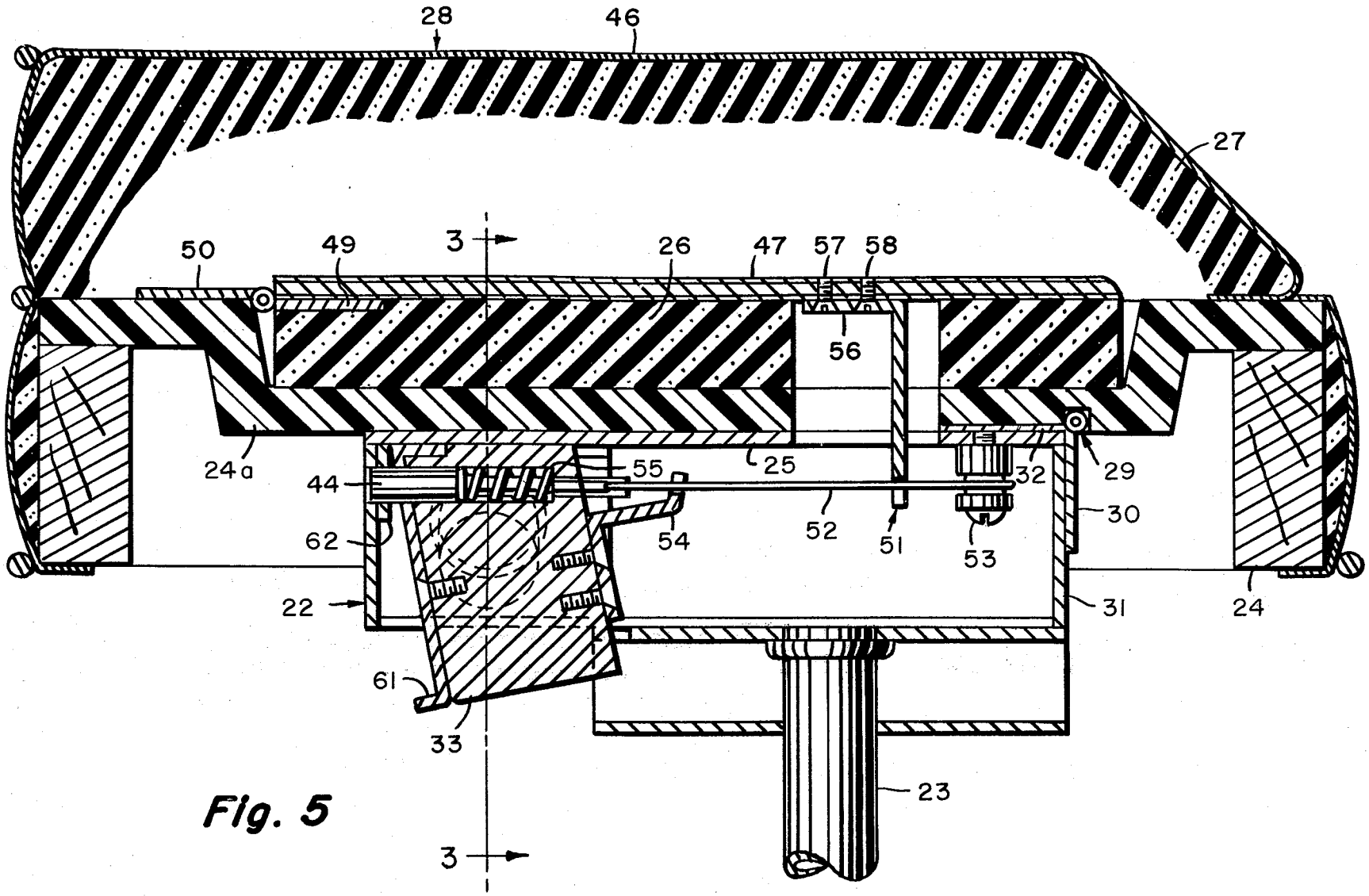
FIG. 5 is a section on the plane 5—5 of FIG. 3.
Figure 6:
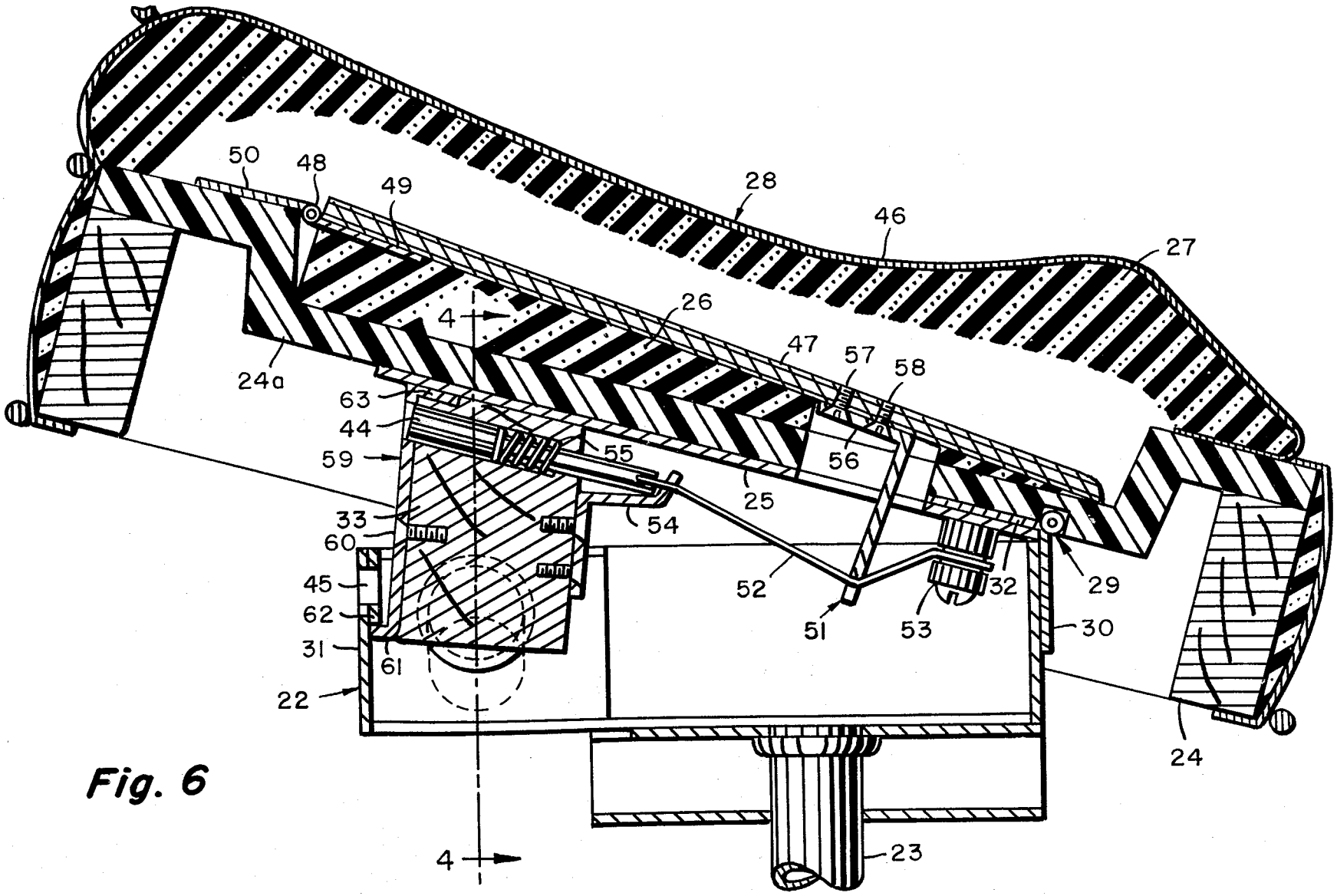
FIG. 6 is a section on the plane 6—6 of FIG. 4.
Figure 7:
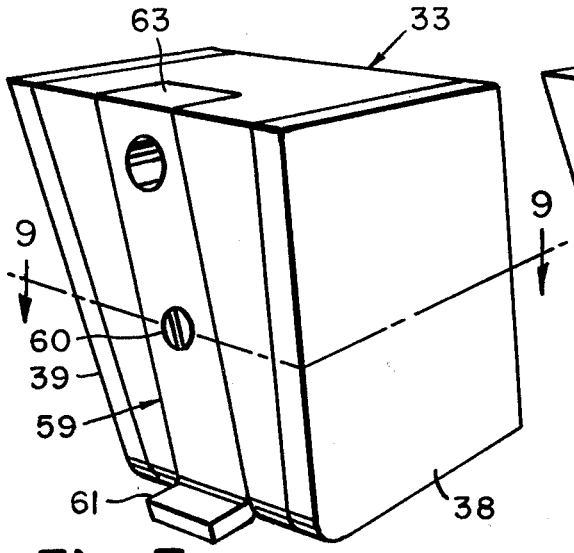
FIG. 7 is a perspective view showing the friction-generating projection secured to the underside of the seat.
Figure 8:
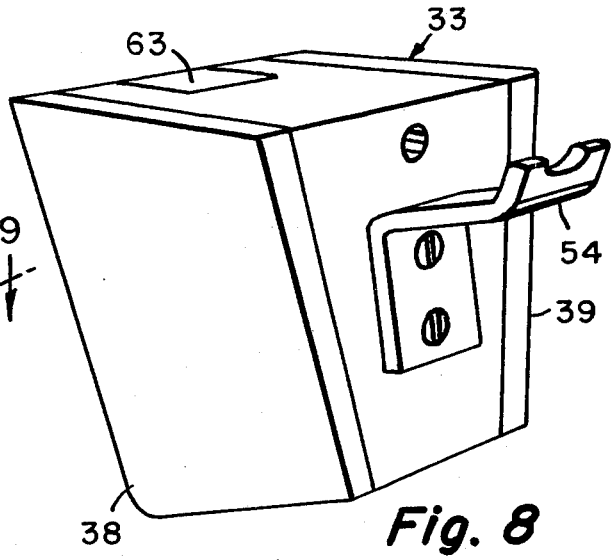
FIG. 8 is a rear view of the components shown in FIG. 7.
Figure 9:
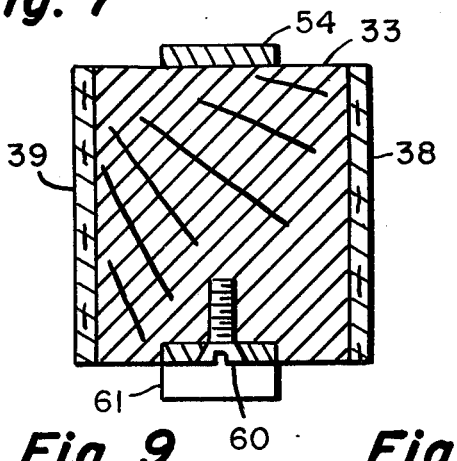
FIG. 9 is a section on the plane 9—9 of FIG. 7.
Figure 10:
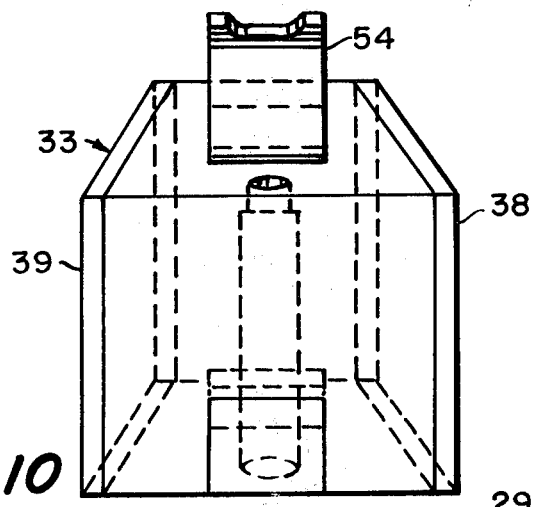
FIG. 10 is a top view of the unit as shown in FIG. 8.

Referring to FIG. 1, the illustrated chair includes a base 20 and a seat-back unit indicated generally at 21. This unit is tiltably mounted on the mechanism 22 secured to the base 20. In FIG. 1, the seat 21 is not adapted to swivel, while FIG. 2 illustrates an arrangement in which the mechanism 22 can as well be mounted on a shaft 23 incorporated in a swivel mechanism. In either case, the tiltable system will be as shown in FIGS. 5 and 6.

The frame of the seat will normally include a peripheral structural member 24 composed of one or more pieces, together with the dish-shaped member **24*a* preferably adhesively secured to the peripheral member 24 to form a solid structure. The member 24*a* may be made in the illustrated offset position providing a central recess by the use of molding techniques involving synthetic, or semi-synthetic materials. The central recess receives upholstering material such as a layer of foam rubber 26, which is also preferably secured in place with adhesive. FIGS. 5 and 6 are drawn with the upper cushioning material 27 removed from the area immediately above the pivot mechanism for clarity. A cover 28** of any selected material will normally be installed according to conventional upholstery procedures.

A hinge 29 has one leaf 30 secured to a box-like frame 31 of the mechanism 22, and the opposite leaf 32 secured in any convenient manner to the plate 25, to which the member 24*a* is secured by conventional fastenings or adhesive. The hinge 29 thus becomes a fulcrum for the tilting of the seat-back unit 21 with respect to the base 20.

Figure 3:
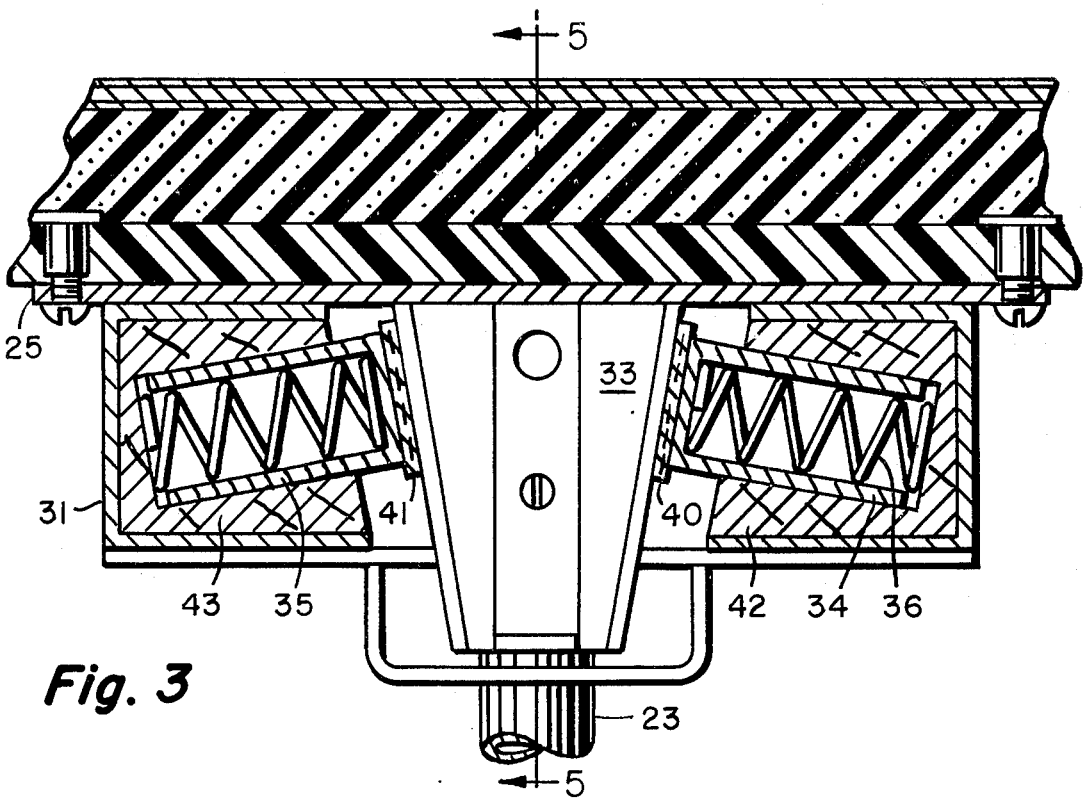
FIG. 3 is a sectional view on a vertical plane generally parallel to the front of the chair, and taken through the center of the friction-generating system with the chair in the upright position.
Figure 4:
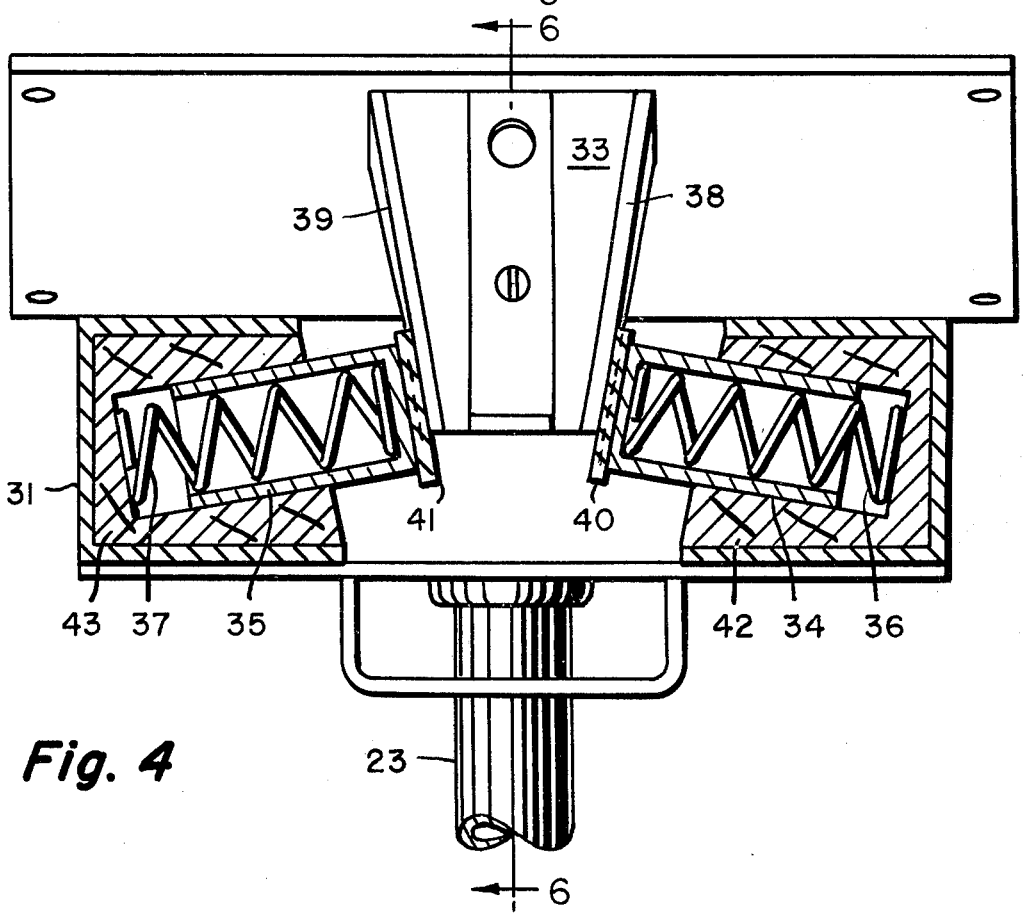
FIG. 4 is a view similar to FIG. 3, showing the relative position of the components with the chair in the tilted position.

A resistance to the tilting action is provided by the projection 33 as it enters between the spring-loaded plungers 34 and 35, appearing best in FIGS. 3 and 4. The springs 36 and 37 drive these plungers, respectively, against the side surfaces of the projection 33, which are formed by layers of material 38 and 39 generally similar to automotive brake lining. It is obvious that the tapered configuration of the projection 33, proceeding to increased width in a direction toward the seat will generate a wedging action tending to separate the plungers 34 and 35 against the action of the springs 36 and 37 as the chair seat moves from the tilted position shown in FIGS. 1 and 4 to the erect position illustrated in FIG. 3. The degree of taper of the projection 33 should be selected with consideration of the materials of the surfaces 38 and 39 of the projection, and the bearing surfaces 40 and 41 of the plungers, so that the slope will not exceed the coefficient of friction between these materials. In other words, there should not be a tendency for the spring pressure to squeeze the seat into a tilted condition. The degree of frictional resistance should preferably exceed the upward force vector resulting from the angularity of the surfaces of the projection 33. This angularity should, of course, be matched by the path of travel of the plungers 34 and 35 so that the surface materials 38 and 39 are engaged from a perpendicular direction. The path of travel of the plungers 34 and 35 is determined by the orientation of the appropriate receptacle holes drilled in the blocks 42 and 43 secured to the frame 31.

To prevent a tendency for the chair to assume a tilted position when unoccupied, as shown in FIG. 1, a locking device is incorporated in the mechanism to maintain the erect position. This lock includes the bolt 44 slidably mounted in the projection 33 for engagement with the keeper aperture 45 in the frame 31 of the mechanism. Pressure on the cover surface 46 is transferred through the cushion material 27 to the panel 47 hinged at 48 to the seat structure. The leaf 50 is attached by any convenient means to the seat member 24*a*, and the opposite leaf 49 is attached to the panel 47. This transferred pressure is correspondingly transferred to the lower cushioning material 26, which yields into the position illustrated in FIG. 6, and causes the actuator 51 to move downward and deflect the tension member 52 from a position initially approaching a straight line. This deflection withdraws the bolt 44, as shown in FIG. 6. The tension member extends from the bolt to the terminal 53 mounted on the plate 25, and also rides over the guide 54 secured to the projection 33 to eliminate a tendency to pull the bolt 44 sideways, and thus interfere with its free movement against the action of the spring 55. Movement of the actuator 51 directly with the panel 47 is assured by the attachment of the base flange 56 to the panel with screws as shown at 57 and 58. The member 24*a* and the cushioning material 26 have aligned apertures providing clearance for this movement of the actuator 51.

The bar 59 is secured to the wood block forming the projection 33 by a screw or screws 60, and contains a hole reinforcing the entrance to the bore carrying the sliding locking bolt 44. At the lower extremity of the bar 59, a flange 61 is bent forward for interengagement with the reinforcement 62 around the keeper opening 45 to form a limit stop to the tilting action of the seat. This condition is illustrated in FIG. 6. At the opposite end of the bar 59, a flange 63 is bent over to conform to the top of the projection 33 to supplement the effect of the screw 60 in maintaining the relative placement of the bar and the wood block.

Figure 11:
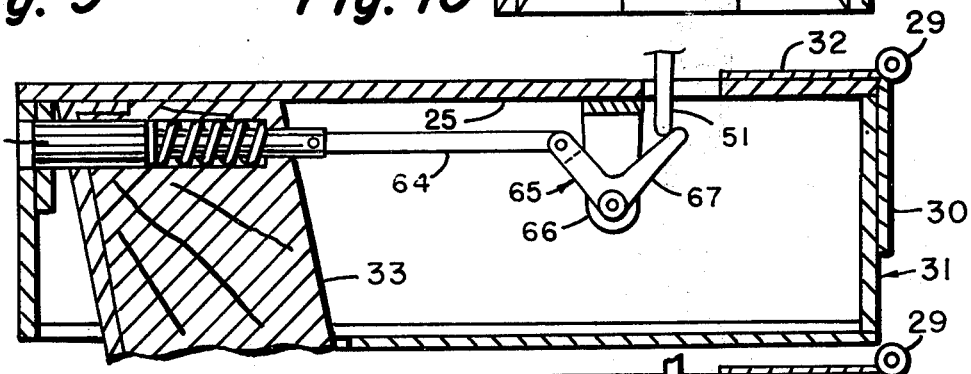
FIG. 11 is a view of a modified form of the actuating mechanism for controlling the lock.
Figure 12:
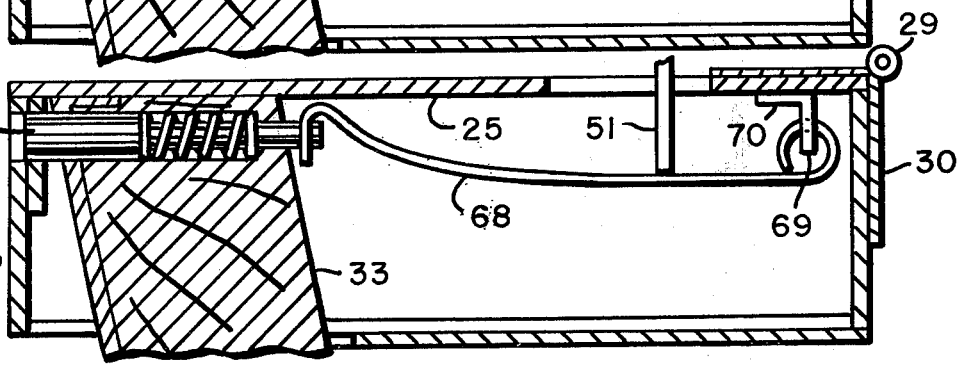
FIG. 12 shows a further modification in the mechanism for actuating the lock.

FIGS. 11 and 12 illustrate alternative forms of actuating the locking bar 44 to release position. In FIG. 11, the link 64 is connected to the bolt 44 and to the crank 65 pivotally mounted on the bracket 66 secured to the plate 25. The actuator 51 engages the arm 67 of the crank 65, and induces a clockwise rotation causing the link 64 to withdraw the bolt 44. In FIG. 12, the actuator 51 bears against a leaf spring 68 functioning in the same manner as the cord tension member 52. The right end of the spring 68 is formed into a coil 69 which hooks through the bracket 70 to form a hinge connection.

Figure 13:
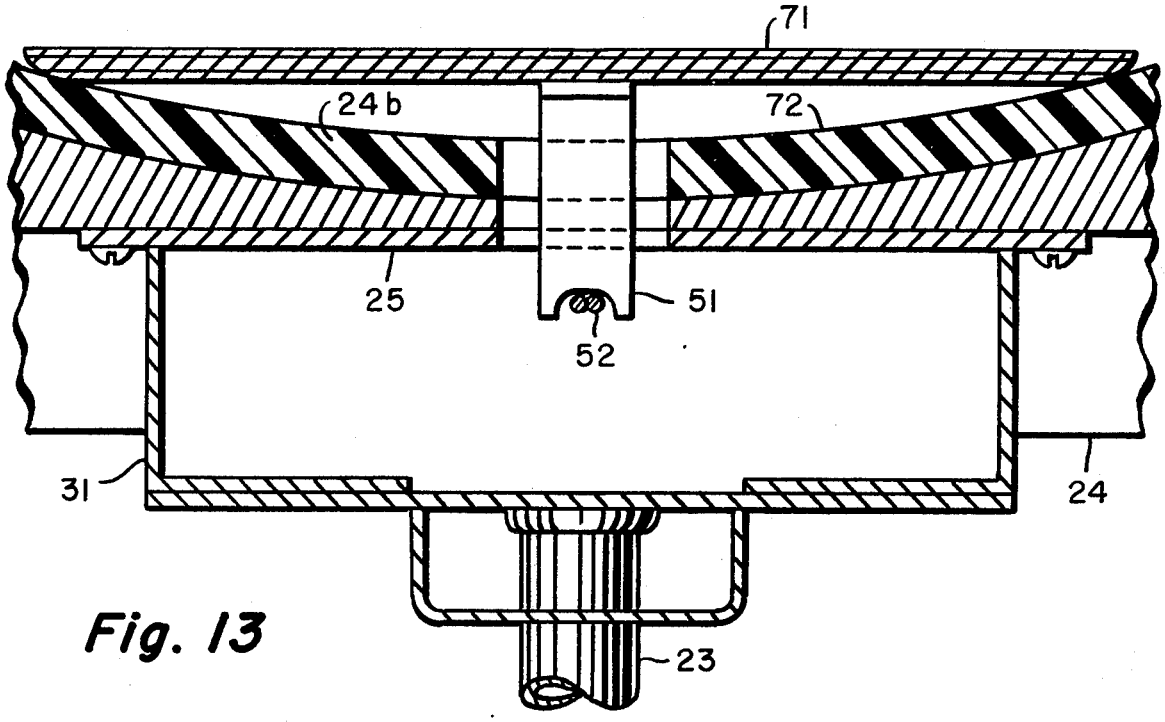
FIG. 13 illustrates the application of the invention to a modified form of seat construction, with the components in the position they would be with the seat unoccupied.
Figure 14:
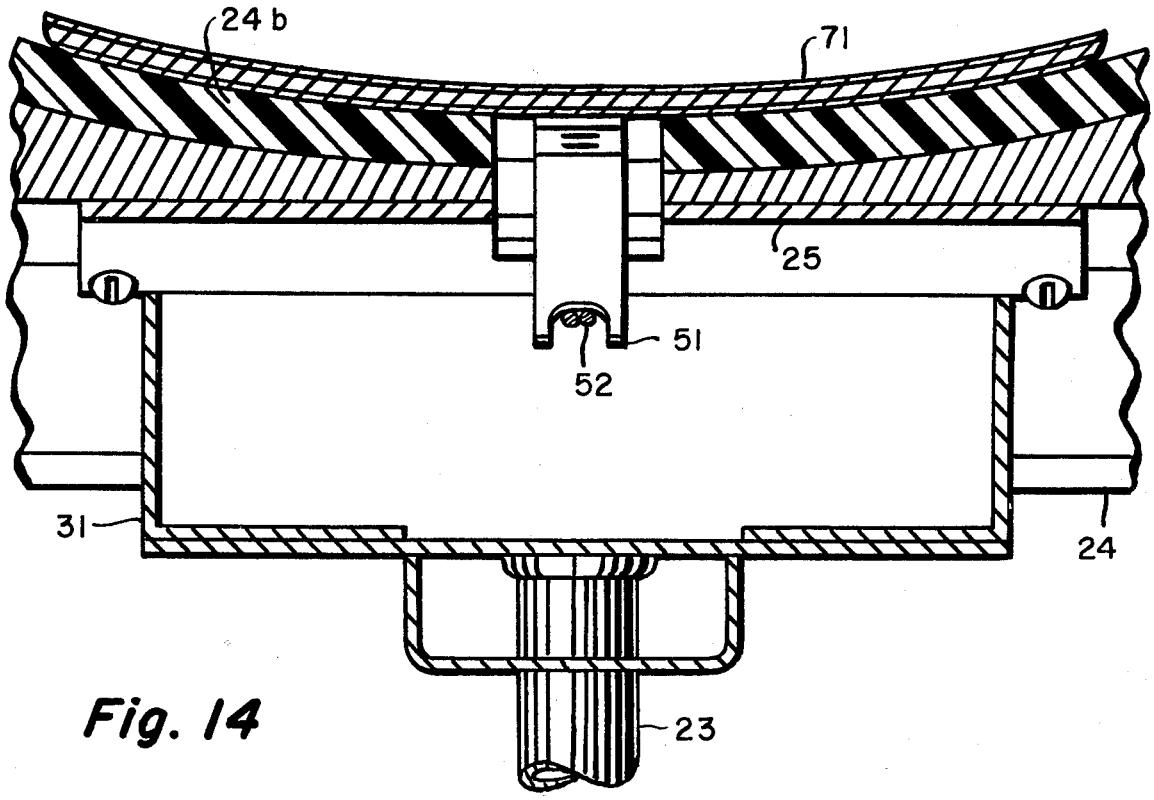
FIG. 14 is a view similar to FIG. 13, showing the relationship of the components with pressure present in the seat.

Referring to FIGS. 13 and 14, an alternative construction is shown which is usable in seats having a considerable degree of curvature from side to side. In this arrangment, the lower cushioning material 26 is eliminated. The panel 71 merely bridges across the curved member 24*b* constituting the seat structure, so that the application of pressure to the seat deflects the panel into conformity with the surface 72 of the member 24*b*, and thus lowers the actuating member 51 in the same manner as is shown in FIG. 6. It may be desirable to locate the deflecting panel 71 laterally by abutments around its periphery, or the panel 71 can be located through adhesive adherence of the cushioning material above it, which is itself laterally located by adhesive, and by the attachment of the cover. It is preferable to locate this panel at least in a front-rear direction, which can be done by securing it to a convenient block interposed between the panel and the seat at the front central area.

I claim:

1. A tiltable support for a chair seat, said support including a base structure, fulcrum means secured to said base structure and adapted to be secured to said seat to establish a pivot axis, and brake means having one portion fixed with respect to said base structure, and another portion normally secured to said seat, said brake means being operable to establish resistance to tilting movement of said seat with respect to said base structure, wherein the improvement comprises:

a member having opposite surfaces, included in one of said brake means portions and extending transversely with respect to said pivot axis; and friction-generating means mounted on the other of said brake means portions for movement along paths generally perpendicular toward and away from said opposite surfaces, respectively, and adapted to bear resiliently on said opposite surfaces, said opposite surfaces converging in a direction to induce maximum displacement of said friction-generating means in the erect position of said seat.

2. A support as defined in claim 1, additionally including releasable locking means interengageable between components fixed with respect to said seat and said base structure, respectively, to secure the erect position of said seat.

3. A support as defined in claim 1, wherein said surfaces converge in a direction away from said seat, and said member is normally mounted on said seat.

4. A support as defined in claim 3 wherein said surfaces converge at an angle to the path of movement thereof, the coefficient of friction between said surfaces and said friction-generating means being sufficient to overcome any tendency for the seat to be squeezed into a tilted condition.

5. A support as defined in claim 3, wherein said opposite surfaces are spaced in a direction parallel to the axis of said fulcrum means.

* * * * *